US008561373B1

(12) United States Patent
McDonald

(10) Patent No.: US 8,561,373 B1
(45) Date of Patent: Oct. 22, 2013

(54) BAMBOO I-BEAM WITH LAMINATED WEB AND FLANGES

(75) Inventor: William D McDonald, Santa Rosa, CA (US)

(73) Assignee: Bamcore LLC, Santa Rosa, CA (US)

( * ) Notice: Subject to any disclaimer, the term of this patent is extended or adjusted under 35 U.S.C. 154(b) by 140 days.

(21) Appl. No.: 12/843,034

(22) Filed: Jul. 25, 2010

Related U.S. Application Data

(60) Provisional application No. 61/228,570, filed on Jul. 25, 2009.

(51) Int. Cl.
*E04C 3/00* (2006.01)

(52) U.S. Cl.
USPC ..... 52/846; 52/841; 52/847

(58) Field of Classification Search
USPC ..... 52/846, 841, 847, 642, 650.1, 693
See application file for complete search history.

(56) References Cited

U.S. PATENT DOCUMENTS 1,377,891 A * 5/1921 Knight ..... 52/841
2,230,628 A * 2/1941 Sahlberg ..... 52/841
2,886,857 A * 5/1959 Brosenius ..... 52/841
3,271,917 A * 9/1966 Rubenstein ..... 52/309.17
4,336,678 A * 6/1982 Peters ..... 52/837
5,664,393 A * 9/1997 Veilleux et al. ..... 52/837
5,972,467 A * 10/1999 Washo ..... 428/107
5,976,644 A * 11/1999 Sanaee et al. ..... 428/17
6,281,148 B1 * 8/2001 Dagher et al. ..... 442/71
7,921,621 B2 * 4/2011 Krestel ..... 52/847
7,981,233 B2 * 7/2011 Wellwood et al. ..... 156/182

* cited by examiner

*Primary Examiner* — Basil Katcheves
(74) *Attorney, Agent, or Firm* — Gary Hoenig

(57) ABSTRACT

A high strength bamboo I-beam is provided comprising a bamboo web formed from bamboo boards formed by splaying, pressing and planing bamboo culm and having flanges laminated to the top and bottom of the web. The I-beam flanges each comprise a laminated bamboo flange element on either side of the web portion wherein the top and bottom edges of the web portion are flush with the top and bottom flanges of the I-beam. The flange elements are formed from laminated strips of splayed, pressed and planed bamboo culm. The I-beam is bonded with non-formaldehyde adhesives. Orientation of the high fiber cortex regions of the bamboo boards imparts structural characteristics to the beam. The bamboo I-beam provides a lightweight, low cost, high strength, and fire resistant load bearing construction component.

15 Claims, 6 Drawing Sheets

BAMBOO I-BEAM WITH LAMINATED WEB AND FLANGES

FIELD OF THE INVENTION

The invention relates to beam type construction materials; and, more particularly to I-beams constructed of bamboo.

BACKGROUND OF THE INVENTION

The use of engineered I-beams in western style construction has become common place particularly for use as a component in floors, joists and beams, as they are both lighter and less prone to warping than solid wood joists. Conventional wood based I-beams typically are constructed from an oriented strand board or fiberboard web bound by top and bottom flange sections also typically constructed of high quality fir or laminated veneer lumber. I-beams are capable of supporting higher loads than an equivalent sized dimensional lumber beam and are therefore an economic means of construction. In a typical application the I-beams are intended to span a distance wherein the ends of the I-beam are supported and a load is applied along the length of the beam. In this configuration, the top flange is longitudinally in compression whilst the bottom flange is in tension. The web material maintains the distance between the top and bottom flanges and is in shear when the beam is under load, very much like the cross members in a truss. Because the load is largely borne by the top and bottom flanges, the flanges must be of high quality material. Ideally the flanges should be constructed from a single continuous piece of lumber or an engineered laminated veneer lumber; however, in practice seams are required to achieve length. Consequently seams must also be designed to bear the required loads.

I-beams constructed of wood have a number of advantages; however, there has been some concern as to their rapid loss of strength in a fire if unprotected. Also, wood as a construction material is general becoming a scarcer commodity, thus increasingly expensive, and the harvesting of wood is coming under increased environmental scrutiny. Various alternate renewable materials have been proposed to replace wood in engineered I-beams; however, ideally one would prefer the use of renewable and sustainable materials that impose a low environmental impact to harvest and process. Bamboo is such a material.

Bamboo is a prolific woody grass that has long been used in various forms as a construction material. Bamboo possesses numerous properties advantageous to the construction industry. Of particular utility is the high compression and tensile strength when used in pole form, also referred to as bamboo cane, as a support member or load bearing element in a structure. However use of bamboo in traditional western construction practices has been problematic as the tubular bamboo culm must be processed into a construction material having western style standardized dimensions, durability and strength characteristics. These difficulties are particularly pronounced as demonstrated by prior art attempts to utilize bamboo in I-beam structures wherein the bamboo is typically shredded, chipped, stranded, flaked and reconstituted into an oriented strand board; or, ripped and milled longitudinally along the culm into solid small narrow strips assembled into stacks and bonded into board form.

Use of bamboo culm in an I-beam component, without compromising the beneficial characteristics of a tubular cane, provides numerous advantages over wood including higher overall strength for the same volume of material content, higher fire resistance, lower weight, and high durability and flexibility.

Bamboo is generally lower cost than wood. Bamboo is fast growing requiring only three to four years before harvesting an individual timber grade bamboo culm, a growth time significantly less than wood. As compared to wood, bamboo has a higher rot resistance and resistance to insect infestation than most woods. Further, bamboo has a higher level of carbon sequestration than most woods. Therefore, what is needed is an I-beam construction component principally utilizing bamboo while maintaining the bamboo culm beneficial structural characteristics largely in tact thereby capitalizing on the advantageous characteristics of bamboo timber while providing a material with substantially consistent and predictable dimensions and structural characteristics such as timber or other load bearing structural components.

SUMMARY OF THE INVENTION

Accordingly, the present invention is directed to an improved load bearing construction material, and, more specifically, to a bamboo based engineered I-beam, and a manufacturing process thereof, having a laminated bamboo web and laminated bamboo flange sections providing light weight construction, high load capacity, low material and manufacturing costs, and high durability, thereby substantially obviating one or more of the problems due to the limitations and disadvantages of the related art.

The bamboo I-beam, according to the present invention, is similar in appearance and dimension to conventional wood or steal I-beams having a central web vertically oriented with top and bottom flange sections each arranged perpendicular to the vertical web and fixed horizontally along the entire top and bottom length of the web section thus forming an I shape. The flanges comprise two flange elements each respectively positioned on opposing sides of the top and bottom edges of the web such that the web is disposed between the flange elements with the edge of the web flush with the outer surface of the flange elements. The flange elements are bonded to the web with construction grade adhesive. The web portion is constructed from prepared bamboo boards with the bamboo grain direction arranged to exploit the high compression and tensile characteristics of bamboo cane so as to maximize the load bearing properties of the I-beam and minimize material content. Similarly, the flange elements comprise laminated prepared bamboo strips also so arranged. The flange elements are constructed such that the bamboo grain direction is arranged parallel to the top and bottom of the beam. Embodiments of the invention are directed towards variations in grain orientation of the various elements and the structure of the web section.

Preparation of the bamboo boards and strips so as to maximize the preservation of the bamboo cane structural characteristics is central to the present invention. The boards and strips are prepared from contiguous portions of bamboo culm by splaying bamboo cane longitudinally and then pressing the culm portions flat in a manner such that damage to the dominant vertical fibers of the culm is minimized. The resulting pressed bamboo is planed to a desired thickness preferentially removing material from the pith surface of the board thereby leaving the high fiber content cortex largely in tact. The process transforms bamboo cane into a flat bamboo board element wherein the liginin binder is randomly fractured allowing the fibers to separate from one another longitudinally with minimal or no damage to the fiber itself. All components of the I-beam, including the bamboo boards and strips, are fashioned from the process bamboo board elements. The I-beam components are laminated together to form the finished beam.

Many objectives of the present invention are achieved principally through the use of and exploitation of bamboo, accordingly prepared and arranged, including, but not limited to, an I-beam having substantially improved load bearing characteristics, for a given material content, as compared to traditional and conventional wooden I-beams generally constructed with oriented strand board webs and dimensional lumber flanges. Generally, bamboo possesses higher tensile and compression properties as compared to wood. The bamboo I-beam, according to the present invention, provides substantially lower deflection than traditional wood based I-beams. Bamboo, being a grass, is high in silicate content improving the fire resistance of the material over wood products. Yet further, the bamboo, being a fast growing plant, is a rapidly renewable resource wherein timber bamboo culm, suitable for constructing the present invention, may be harvested from the same plant each year. The bamboo content required to yield a dimensionally equivalent sized wood based I-beam provides an I-beam of substantially higher strength and improved performance. Timber bamboo, the constituent material, is readily available, low cost, renewable, and has high carbon sequestration properties.

BRIEF DESCRIPTION OF THE DRAWINGS

The accompanying drawings, which are incorporated in and constitute a part of this specification illustrate embodiments of the invention and, together with the description, serve to explain the features, advantages, and principles of the invention.

In the drawings.

DETAILED DESCRIPTION OF THE INVENTION

Figure 1:
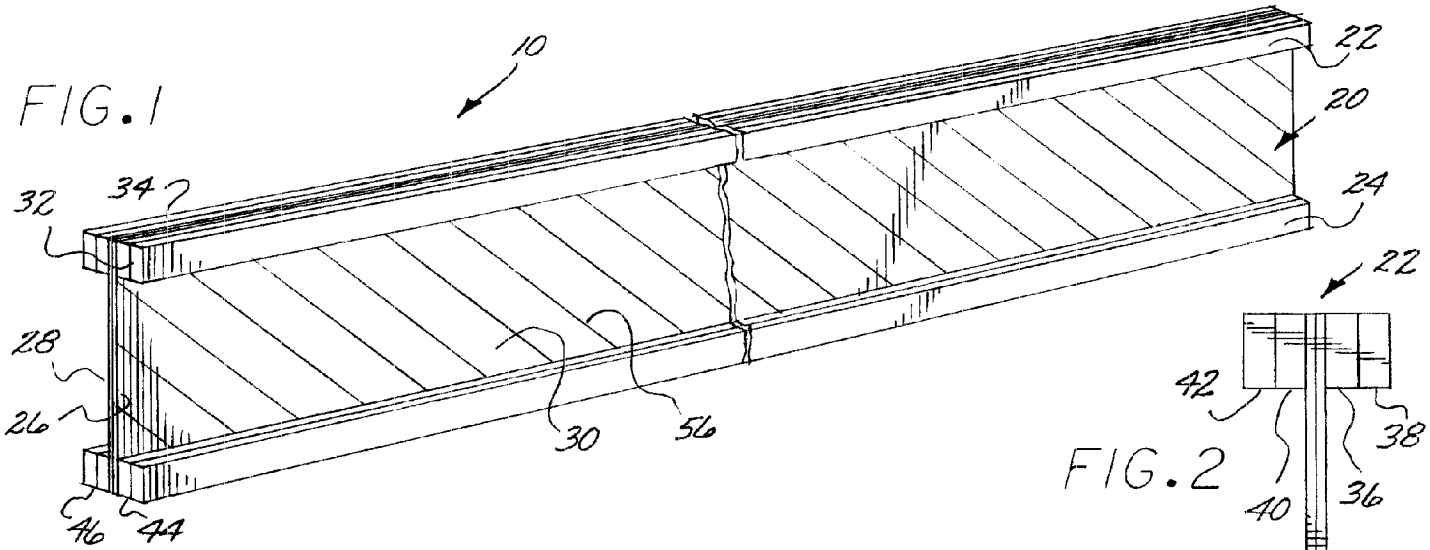
FIG. 1 is a perspective view of the bamboo beam according to the present invention.

Although particular embodiments of the invention have been described in detail for purposes of illustration, various modifications may be made without departing from the spirit and scope of the invention. As used herein, the term "wood" refers to tree based material as distinguished from bamboo, which is grass based. Where examples are presented to illustrate aspects of the invention, these should not be taken as limiting the invention in any respect. Referring now in greater detail to the various figures of the drawings wherein like reference characters refer to like parts, there is shown in a perspective view at 10 in FIG. 1, a new type of bamboo I-beam.

Referring to FIG. 1, a perspective view according to the present invention, the bamboo I-beam 10 comprises a web 20, a top flange 22 and a bottom flange 24 with the flanges parallel to one another. The web 20 comprises a plurality of splayed, pressed and planed bamboo boards, typified at 30, arranged adjacent to one another, along the longitudinal sides of the boards, to form a contiguous layer of boards. The flanges 22 and 24 further each comprise an inner and outer flange element laminated opposing each other to the vertical sides of the web 20 wherein each flange element further comprises, at least, two splayed, pressed and planed bamboo strips and laminated together. The flange element strips 36, 38, 40, and 42 with the web disposed between strips 36 and 38 form the top flange 22; and, flange element board strips 44, 46, 48, and 50 with the web disposed between strips 46 and 48 form the bottom flange 24. In this embodiment a first flange element comprising flange element strips 36 and 38 and a second flange element comprising flange element strips 40 and 42 are laminated to the web portion using construction grade adhesive such that the laminations of the first and second elements are the oriented in the same direction. Although the laminations are illustrated parallel to the web, the flange elements may be arranged to be perpendicular to the web.

All components of the I-beam 10 are formed by laminating splayed, pressed and planed bamboo stock trimmed into bamboo boards and strips that are specifically arranged and bonded with adhesive so as to maximize the strength and provide the dimensional requirements of a specific size of I-beam. The bamboo is harvested from preferably from timber bamboo. The bamboo cane is then splayed longitudinally. The splaying, pressing and planning process produces flat bamboo board stock having widths of typically 8 to 10 inches depending upon the culm diameter, a length dependent upon the cane length and a thickness defined by the thickness of the culm wall less material sacrificed during processing so as to achieve a specified thickness. The bamboo board stock is trimmed into bamboo boards and strips each having opposing sides parallel to each other, adjacent sides perpendicular to each other, a length, a width and thickness with longitudinally oriented grain. In trimming the boards to width, the maximum width should be trimmed from the stock whilst also keeping the longitudinal edges parallel. Variations in board widths are tolerated in the design. Maximizing the width also maximizes the use of the bamboo. The grain direction is maintained parallel to the longitudinal dimension of the trimmed boards and strips. Being fabricated from a contiguous portion of the bamboo culm, the bamboo board stock has a high fiber cortex face and a softer opposing pith face. The pith face is therefore preferentially planned to achieve the finished thickness to maximize preservation of the high fiber cortex face. The cutaneous surface of the cortex need only be planned to provide a uniformly level the surface and to remove the waxy surface layer of the culm.

In one embodiment of the invention, the web portion of the I-beam comprises a plurality of splayed, pressed and planed bamboo boards, typified at 30, arranged contiguously and adjacent to each other with the longitudinal edges contacting a forming a single bamboo board layer being the web. The contact regions between the bamboo boards, being the seams, typified in another embodiment at 56 may optionally be fixed with adhesive. This assemblage of bamboo boards forming the single bamboo board layer, is trimmed to the height required for the I-beam such that the seams 56 between the bamboo boards are either perpendicular or at an angle to the top and bottom of the I-beam. The web is disposed between flange elements along the top and bottom longitudinal edges of the web to form top and bottom flanges. The flanges elements comprise laminated bamboo strips with grain direction alike and parallel to the longitudinal dimension of the beam.

Figure 2:
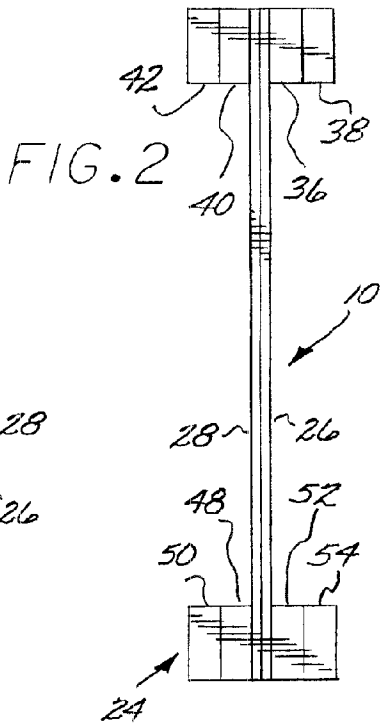
FIG. 2 is an end view of the bamboo beam of FIG. 1.
Figure 3:
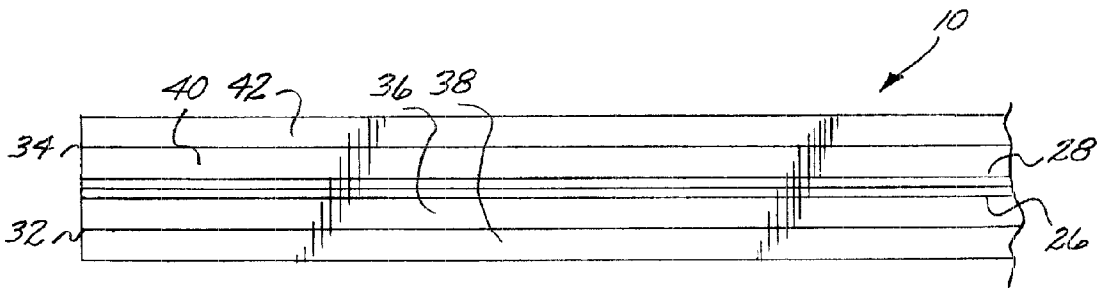
FIG. 3 is a top plan view of the bamboo beam of FIG. 1.

In another embodiment, as illustrated in the figures, the web comprises a plurality of bamboo board layers wherein the each layer is arranged relative to the adjacent layer with the seams of each layer at differing angles such that the layer seams do not coincide with each other along the longitudinal length. Referring to FIGS. 1, 2 and 3, an embodiment having a web 20 comprising two bamboo board layers 26 and 28. The bamboo board layers together as a web assemblage are trimmed to size suitable for the I-beam. The top 22 and bottom 24 flanges of the I-beam 10 are also constructed from the bamboo stock. The top flange 22 comprises first and second flange elements, 32 and 34, bonded to the top region of the vertical sides of the web portion 20. The bottom flange 24 comprises first and second flange elements, 44 and 46, bonded to the bottom region of the vertical sides of the web 20. Each flange element comprises at least two bamboo strips laminated together on the top and bottom surfaces to form a flange element having at least twice the thickness of a single bamboo strip. In the illustrated embodiment, bamboo flange elements 32 and 34 and bamboo flange elements 44 and 46 of the bottom flange 24 are thusly formed by laminating bamboo strips 40 with 42, 48 with 50, 36 with 38, and 52 with 54. The assembled flange elements 32 and 34 and 44 and 46 are trimmed to the dimensions required to form a symmetrical flange shape. The top and bottom flange elements and web assemblage are arranged in the form of an I-beam with each flange element positioned on opposing sides of the top and bottom edges of the web such that the edge of the web portion is flush with the surface of the flanges thus forming a continuous flat top and bottom surface of the I-beam. The elements are bonded to the web with constructive adhesive wherein adhesive is applied between the flange elements and the web assemblage. It will be appreciated that adhesive may optionally also be applied between the bamboo board layers 26 and 28 of the web in areas removed from the flange region as required for specific applications. It will be further appreciated that the bamboo flange elements having at least one lamination defined as the contact surfaces between faces of the bamboo strips may be oriented relative to the web such that the laminations of the flange elements are either parallel, as illustrated in the figures, or perpendicular to the vertical sides of the web.

Figure 4:
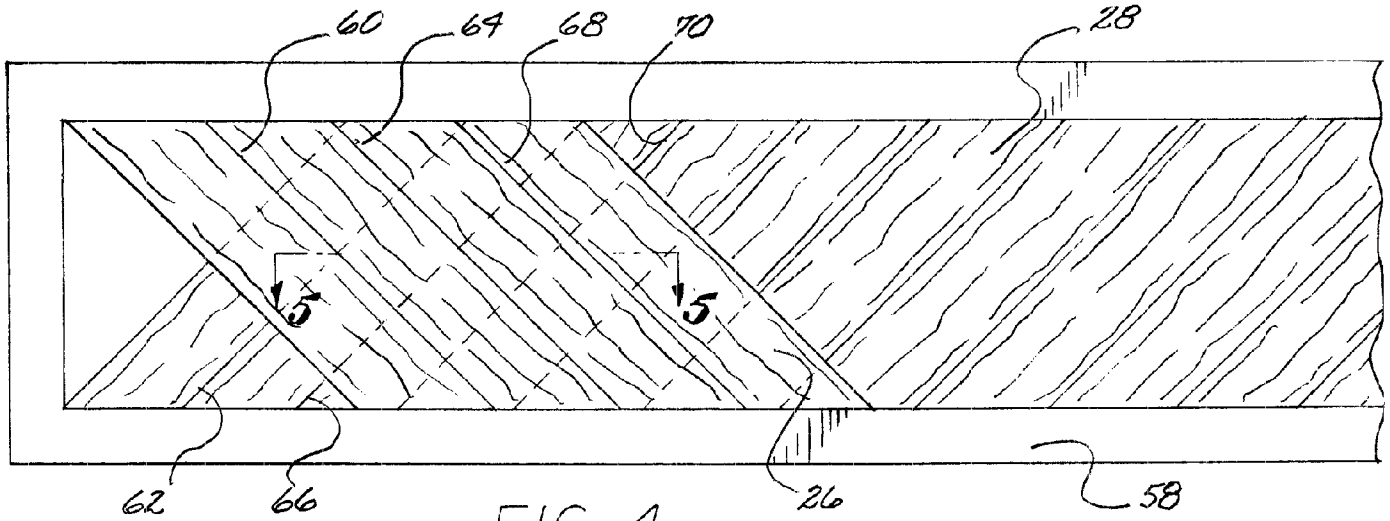
FIG. 4 is a view looking down on a web section according to the present invention in a form during manufacturing.
Figure 5:
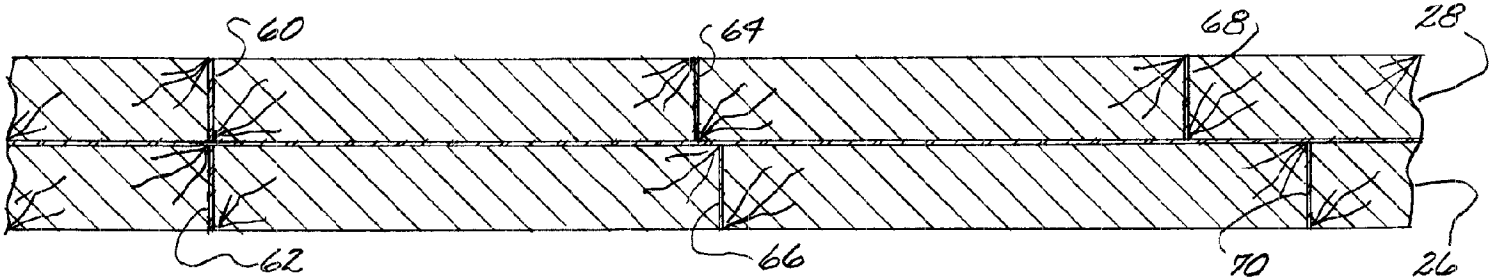
FIG. 5 is a cross section view taken on Line 5-5 of FIG. 4 showing the two bamboo board layers of the web positioned adjacent to one another forming the I-beam web.

Referring now to FIG. 4 showing the trimmed bamboo web assemblage partially assembled in a jig 58 and prior to bonding of the flange elements wherein the second bamboo board layer 28 is complete and the first bamboo board layer 26 is partially complete. In the illustrated embodiment, the bamboo board layers are trimmed such that the seams of the bamboo board layers are arranged at angle to each other. As the width of the bamboo boards is dependent upon the bamboo cane diameter, the arrangement of boards necessarily provides a web assemblage wherein the seam intersections are staggered across the height of the web portion. The seam intersections are illustrated in FIG. 5 taken along line 5-5 of FIG. 4 being a longitudinal section of the web portion. The seam 62 of the second bamboo board layer and 60 of the first bamboo board layer coincide at line 5-5; however, seams 66 and 64, and 70 and 68 do not coincide thereby minimizing weak areas in the web portion.

Figure 6:
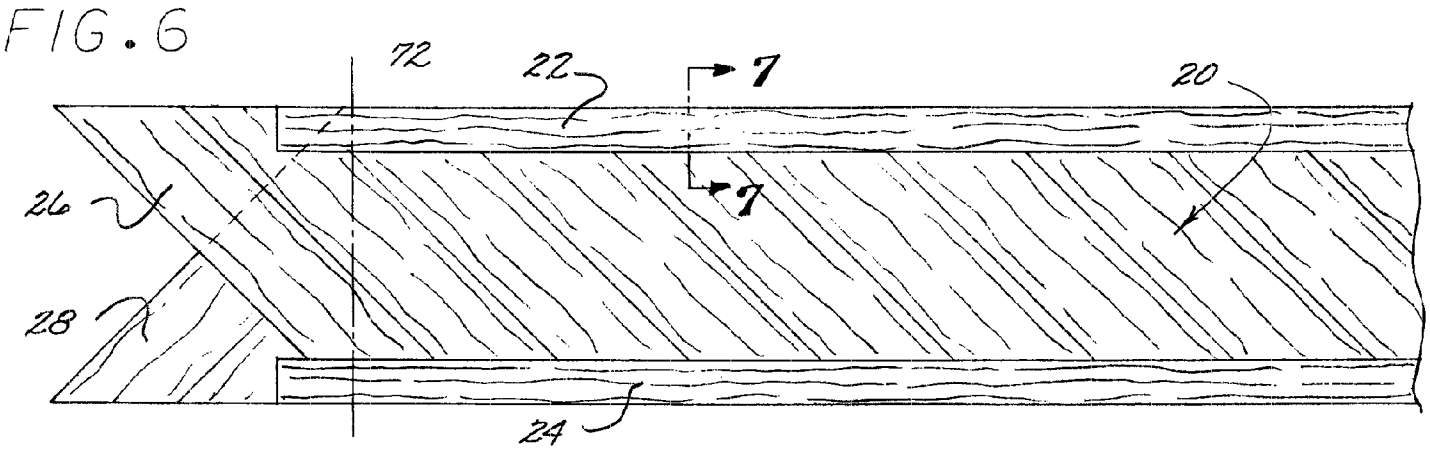
FIG. 6 is a side elevation view of the bamboo beam illustrating top and bottom flange elements of the top and bottom flanges and the finishing cut line wherein the beam is selectively trimmed to the desired longitudinal dimension.

The embodiment illustrated in FIG. 6 comprises untrimmed bamboo board layers 26 and 28 of the web 20 extending from one end of the I-beam with the flanges 22 and 24 bonded to the web 20 prior to trimming to a finished length at cut line 72.

Proper lamination of the elements of the bamboo I-beam is essential to achieve maximum performance. A non-formaldehyde adhesive is preferred so as not to degrade the environmental benefits the bamboo based beam. Further, minimizing the glue lines also necessarily reduces the material costs of the finished product particularly as non-formaldehyde adhesives are presently more costly. In cross section of the top flange section of the I-beam of FIG. 7 taken on Line 7-7 of FIG. 6, the glue lines are illustrated. The minimal number of glue lines are a first glue line at 74 between outer flange element inner and outer strips 36 and 38, a second glue line at 76 between the outer flange element inner strip 36 and the first bamboo board layer 26, a third glue line at 78 between the first and second bamboo board layers 26 and 28, a fourth glue line at 80 between the second bamboo board layer 28 and the inner flange element inner strip 40, and a fifth glue line at 82 between the inner flange element inner and outer strips 40 and 42. The bottom flange section 24 is bonded in the same manner. Note that the third glue line 78 extends from the top of the I-beam to the bottom of the flange section only, thereby the bamboo board layers are free to slide relative to each other. Alternate embodiments may extend the third glue line 78 across the entire height of the web portion as required for a particular application.

Referring further to the structural characteristics of the component bamboo boards, the bamboo culm contains fiber and tubular vascular components positioned axially along the length of the culm. The fiber and vascular components are intraspaced with a natural polymer lignin that acts, in part, as a binder. The density of fibers and vascular components increases towards the cortex of the bamboo culm. Conversely, the density of fiber and vascular components is lowest near the inner diameter, or pith surface, of the culm where the structure is dominated by lignin. Higher density fiber and vascular components provide higher strength. The cortex of the culm also comprises, amongst other elements and irregular features, a waxy cutaneous material that interferes with the efficient binding of adhesives with the bamboo culm. Therefore, the outside surface of the bamboo board is, more specifically, planned to remove the outer nodes, flatten and disrupt or remove the cortex only to the extent as to provide adequate surface area for keying adhesives required for binding the bamboo with adjacent laminate layers.

Consequently, the orientation of the higher fiber density side of the bamboo boards and strips relative to adjacent I-beam elements influences the performance of the beam. The bamboo board layers of the web, according to the present invention, may be arranged such that the cortex sides of the boards are positioned uniformly outwardly or inwardly as required to achieve a desired performance of the beam. The web portion may therefore be assembled with both layers having the cortex side facing outwardly or inwardly. Configurations having the cortex face outwards yield a stiff web element. In embodiments utilizing a web having a single bamboo board layer, the cortex face is direction is preferably alternated in each adjacent board. It will be appreciated that the various possible combinations of arrangement of the cortex side of the individual boards are optional embodiments.

Similarly, the flange element strips of the flanges may be assembled with various orientations of the cortex side of the flange element strips relative to each other. A strip having higher stiffness is achieved by assembling the flange element strips such that the cortex face is positioned outwardly on the assembled flange element. Tests show that the orientation of cortex face of the strips when more than two strips are utilized does not have a significant impact to the overall stiffness of the flange element.

Figure 7:
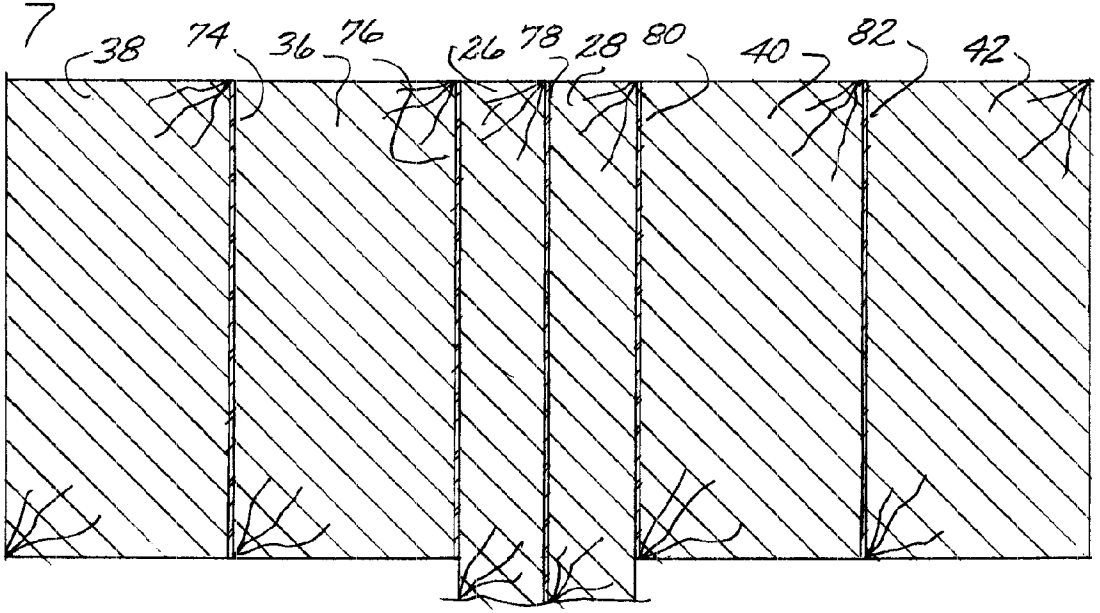
FIG. 7 is a cross section view taken on Line 7-7 of FIG. 6 showing the laminated structure of the flange region of the bamboo beam.
Figure 8:
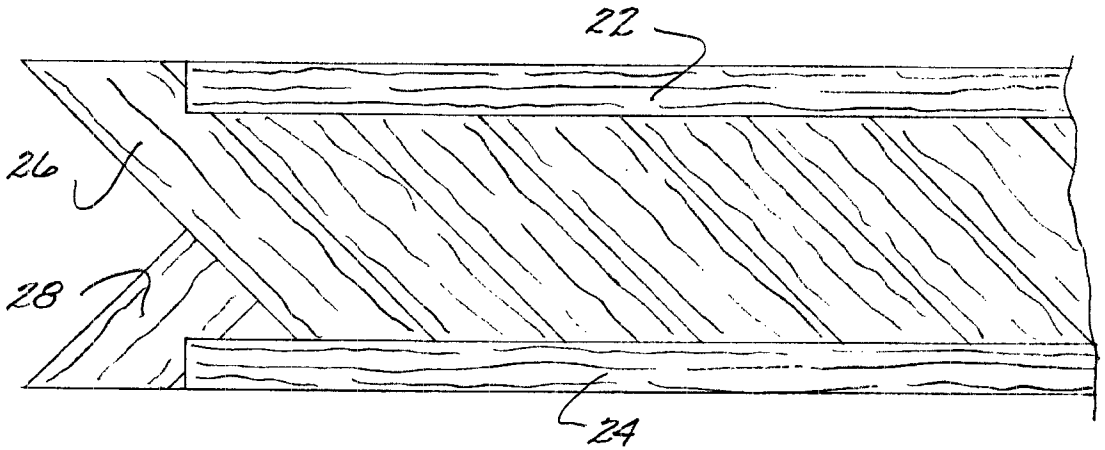
FIG. 8 is a side elevation view of an end of a beam with web bamboo board layers and flange elements in a form suitable for splicing beam sections.
Figure 9:
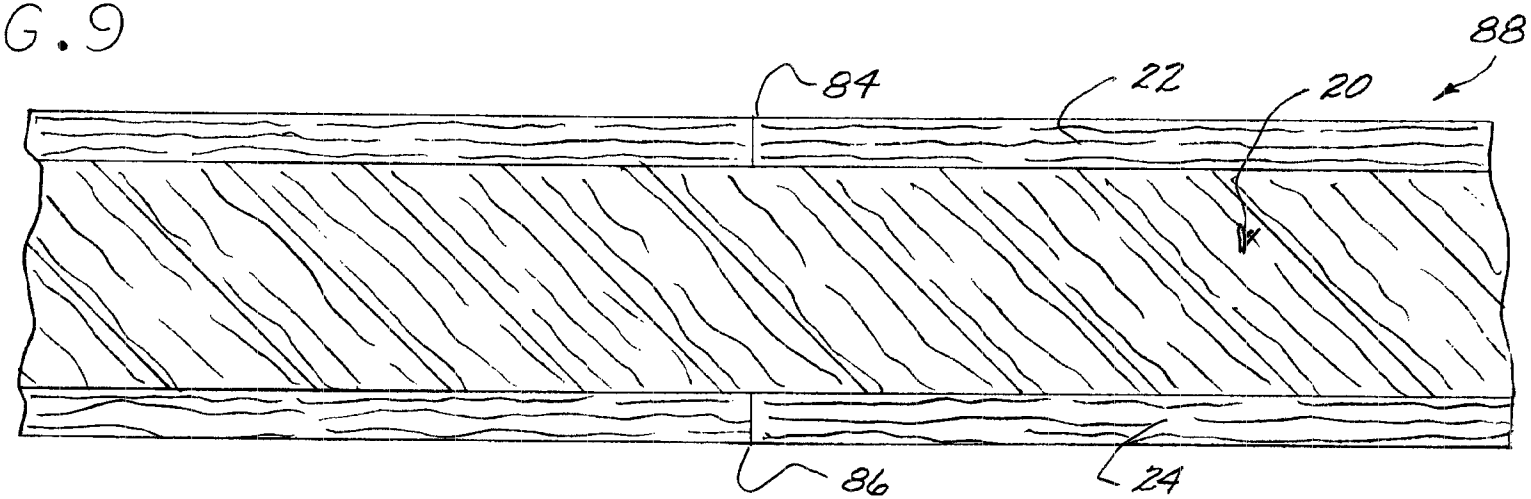
FIG. 9 is a side elevation view illustrating the resulting seam area of an extended beam spliced from two beam sections with overlapping, staggered laminated bamboo flange elements of the flange and overlapping bamboo board layers of the web.

Referring to FIG. 7, optionally and in alternative to the embodiment of FIG. 6, when longer I-beam lengths are required, the extending portions of the untrimmed bamboo board layers 26 and 28 may be interlocked with a similar untrimmed portion of another I-beam and bonded together. The top and bottom flanges 22 and 24 may optionally be figure, dado cut or tongue and groove cut on the exposed ends so as to interlock with each other. The processes may be repeated to construct a desired length of I-beam yielding a splice extension beam 88, as illustrated in FIG. 9, with a continuous web portion 20 wherein the limited witness of the splice being the top and bottom flange splice joints 84 and 86.

Figure 10:
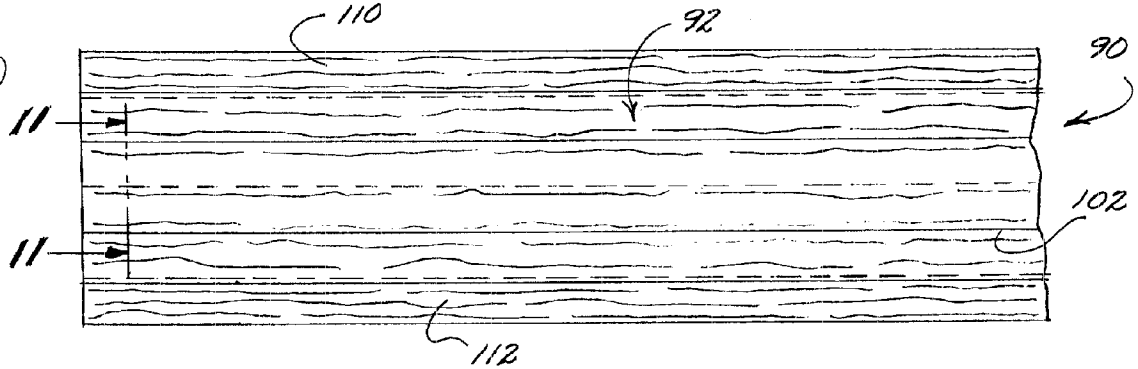
FIG. 10 is a side elevation of the web portion of an alternate embodiment of the beam of FIG. 1 wherein the splayed bamboo board layers are arranged with the grain direction of the bamboo boards parallel to the top and bottom flanges thereby running horizontally along the beam.

A further embodiment of the present invention is illustrated in FIG. 10 showing an I-beam 90 with a web portion wherein the bamboo boards of a first and second web bamboo board layer are arranged such that the boards are all positioned horizontally in the beam and thus parallel to the top and bottom flange 110 and 112. In this embodiment, the manner of preparation of the web assemblage is important. In FIG. 10, two layers of bamboo boards, planed to a desired thickness, are arranged longitudinally side by side such that the seams between the boards do not align with a seam in the adjacent bamboo board layer.

Figure 11:
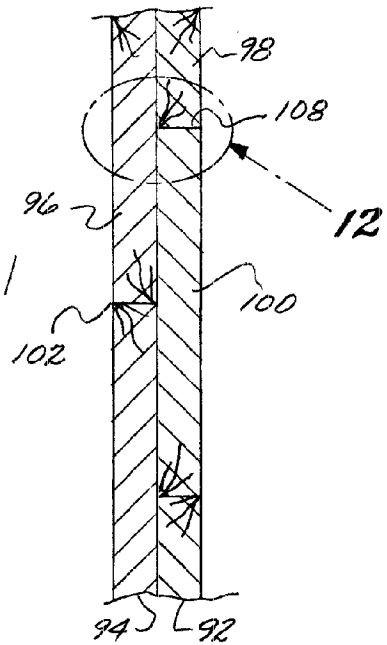
FIG. 11 is a cross section view taken on Line 11-11 of FIG. 10 illustrating the staggered arrangement of the joints in the web between the bamboo boards within each layer relative to the joints in the adjacent layer.
Figure 12:
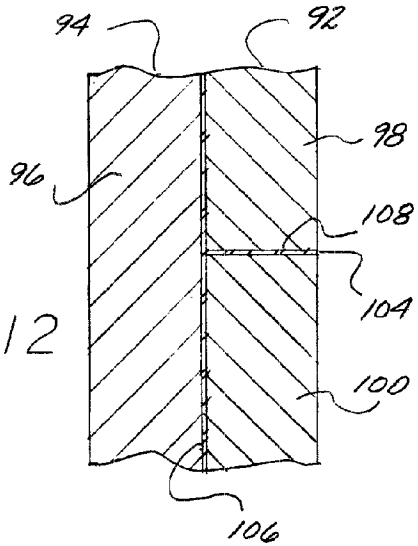
FIG. 12 is an enlarged view of a cross section of the web illustrating the arrangement of the glue lines.

In FIG. 11, taken on Line 11-11 of FIG. 10, details are shown directed towards the staggered nature of the arrangement of the seams of the horizontal oriented boards of the first horizontal board layer 92 and the second horizontal board layer 94 wherein horizontal boards 96, 98 and 100 are arranged such that horizontal seams 102 and 108 do not coincide thereby providing a overlap to improve structural integrity of the web portion. Horizontal boards 98 and 100 of the layer 92 are joined at seam 108 with adhesive and further laminated with adhesive to the board 96 of layer 94. Referring now to FIG. 12 showing the details of the bonding, seam 108 between boards 98 and 100 is filled with an adhesive glue line 104. Similarly layers 92 and 94 are also bound with glue line 106, thereby the embodiment requires the entire web portion to be laminated and bond in all seams.

Figure 13:
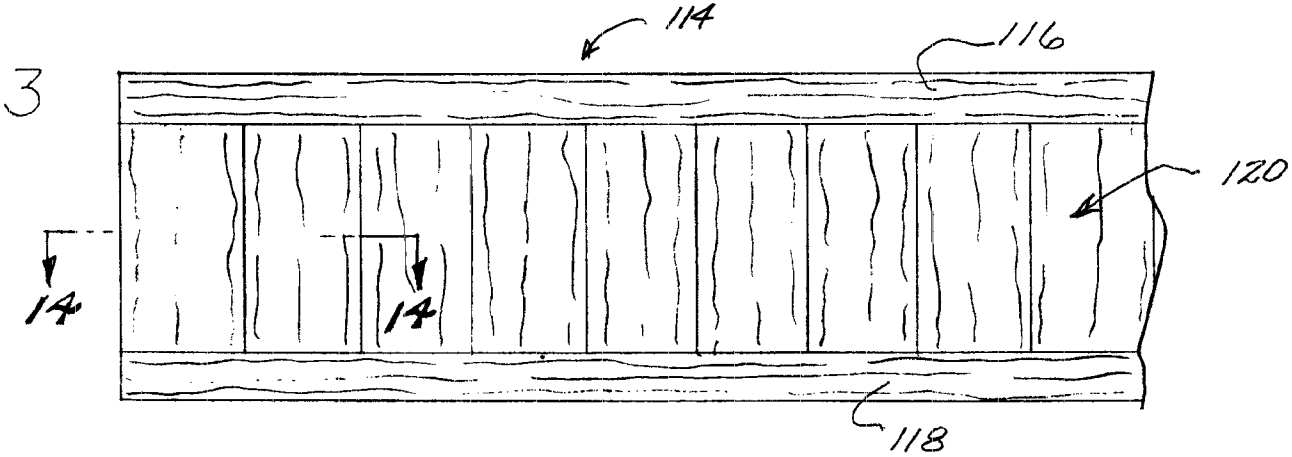
FIG. 13 is a side elevation view of a further alternate embodiment wherein the bamboo boards of the web layers are arranged with the grain of the web layers vertical and perpendicular to the top and bottom flanges.

A further embodiment of the present invention is illustrated in FIG. 13 showing an I-beam 114 with a web portion wherein the bamboo boards of a first and second web bamboo board layer are arranged such that the boards are all positioned vertically in the beam and thus perpendicular to the top and bottom flange sections 116 and 118. In FIG. 13, two layers of splayed and pressed bamboo boards, planed to a desired thickness, are arranged longitudinally side by side such that the seams between the boards do not align with a seam in the adjacent bamboo board layer.

Figure 14:
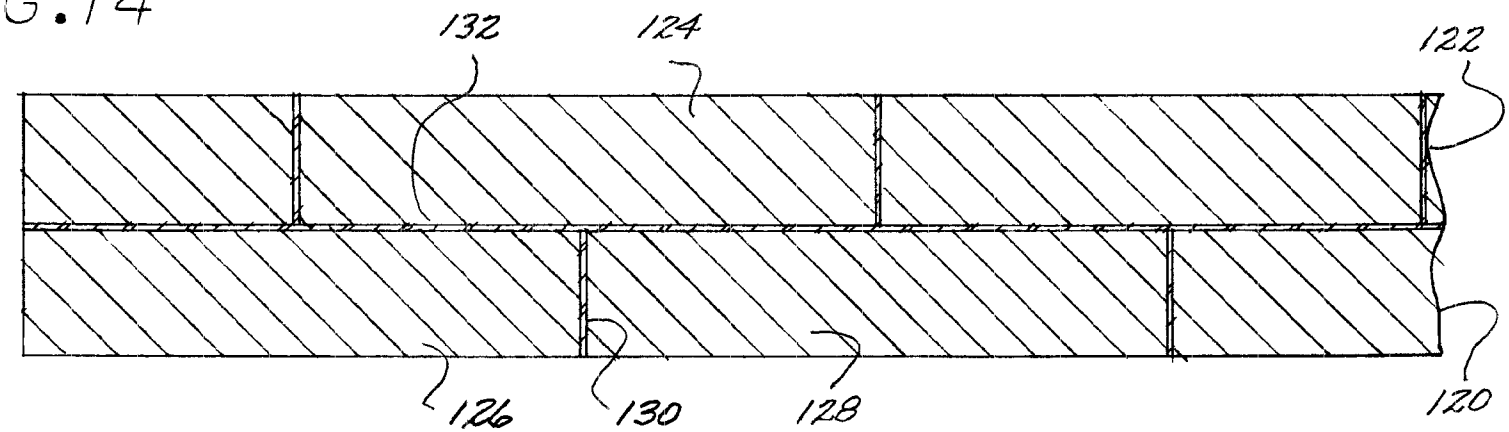
FIG. 14 is a cross section view taken on Line 14-14 of FIG. 13 illustrating the staggered arrangement of the joints between the bamboo boards within each layer relative to the joints in the adjacent layer.

In FIG. 13, the arrangement of the boards of the vertically oriented web portion is illustrated wherein the boards are arranged are during assembly such that as the boards are positioned so that the seams between the board layers 120 and 122 do not coincide. Details of the assemblage for the vertically oriented web beam are shown in FIG. 14, a view taken on Line 14-14 of FIG. 13. In this embodiment, board 124 of the second layer 122 spans the seam 130 of between first layer 120 boards 126 and 128. The seam 132 in the second layer is preferably positioned so as not to coincide with a seam in the first layer. Note that adhesive is not required in this seam. Similarly, adhesive is not required in the seam between layers 120 and 122. However, adhesive is always required at the top and bottom flange 116 and 118 regions in this embodiment.

I claim:

1. A high strength bamboo I-beam comprising:

a web portion comprising a first bamboo board layer being a plurality of bamboo boards each being a portion of splayed bamboo culm, and each having front and back faces, side edges, top and bottom edges, a length, a width and a thickness wherein the bamboo boards are oriented parallel to one another along the side edges having grain direction alike, and a second bamboo board layer arranged face to face with the first bamboo board layer, a first flange comprising first and second laminated bamboo flange elements each element having a top and a bottom surface and laminations of splayed bamboo culm wherein the web portion is disposed between the first and second laminated bamboo flange elements with the top edge of the web portion flush with the top surface of the first and second laminated bamboo flange elements; and, a second flange comprising third and fourth laminated bamboo flange elements each element having a top and a bottom surface and laminations of splayed bamboo culm wherein the web portion is disposed between the third and fourth laminated bamboo flange elements with the bottom edge of the web portion flush with the bottom surface of the third and fourth laminated bamboo flange elements each being adjacent to the web portion, wherein the laminations of the laminated bamboo flange elements are disposed parallel to the top and bottom surfaces of each flange element thereby positioning the laminations perpendicular to the sides of the adjacent web portion, whereby the assemblage forms an I shaped beam.

2. The high strength bamboo I-beam of claim 1, wherein the bamboo boards are each a contiguous portion of bamboo culm.

3. The high strength bamboo I-beam of claim 1, wherein the bamboo boards of the bamboo board layers of the web portion are arranged so that adjacent side edges contact one another.

4. The high strength bamboo I-beam of claim 1, wherein the laminated bamboo flange elements each comprise a plurality of bamboo strips oriented parallel to one another having grain direction alike.

5. The high strength bamboo I-beam of claim 4, wherein the front face of the bamboo strips being formed from a contiguous portion of bamboo culm comprises the cortex portion of the bamboo culm and the back face comprises the pith portion of the bamboo culm, the top and bottom surfaces of the bamboo flange elements, being the surfaces parallel to the laminations of the element, are the back face of the bamboo strips.

6. The high strength bamboo I-beam of claim 4, wherein the front face of the bamboo strips being formed from a contiguous portion of bamboo culm comprises the cortex portion of the bamboo culm and the back face comprises the pith portion of the bamboo culm, the top and bottom surfaces of the bamboo flange elements, being the surfaces parallel to the laminations of the element, are the front face of the bamboo strips.

7. The high strength bamboo I-beam of claim 1, wherein the laminated bamboo flange elements are fixed to the web portion such that the grain of the laminated bamboo flange element is oriented parallel to the longitudinal dimension of the beam.

8. The high strength bamboo I-beam of claim 1, wherein the splayed bamboo is bamboo stock prepared by splaying a bamboo culm along the longitudinal dimension, pressing flat and planing to a desired thickness wherein the pith surface of the bamboo culm is preferentially planed to achieve a desired thickness whilst maximizing the preservation of the high fiber density cortex surface.

9. The high strength bamboo I-beam of claim 1, wherein the bamboo boards of the web portion are disposed with the grain direction of the bamboo boards perpendicular to the flanges.

10. The high strength bamboo I-beam of claim 1, wherein the first and second bamboo board layers of the web portion are disposed with grain direction alike.

11. The high strength bamboo I-beam of claim 1, wherein the first and second bamboo board layers of the web portion are disposed with grain direction at an angle relative to one another.

12. The high strength bamboo I-beam of claim 1, wherein the front face of the bamboo boards comprises the cortex portion of the bamboo culm and the back face comprises the pith portion of the bamboo culm, the first and second bamboo board layers of the web portion being disposed with the back faces adjacent so as the surfaces defined by the pith portion are facing each other.

13. The high strength bamboo I-beam of claim 1, wherein the front face of the bamboo boards comprises the cortex portion of the bamboo culm and the back face comprises the pith portion of the bamboo culm, the first and second bamboo board layers of the web portion being disposed with the top faces adjacent so as the surfaces defined by the cortex portion are facing each other.

14. The high strength bamboo I-beam of claim 1, wherein a layer of construction adhesive is disposed between the first and second bamboo board layers of the web portion.

15. The high strength bamboo I-beam of claim 1, wherein a layer of construction adhesive is disposed between the first and second bamboo board layers of the web in the region of the first and second flanges.

* * * * *